US008672431B2

(12) United States Patent
Chen et al.

(10) Patent No.: US 8,672,431 B2
(45) Date of Patent: Mar. 18, 2014

(54) SLIDE RAIL ASSEMBLY

(75) Inventors: Ken-Ching Chen, Kaohsiung (TW); Shun-Ho Yang, Kaohsiung (TW); Chun-Chiang Wang, Kaohsiung (TW)

(73) Assignees: King Slide Works Co., Ltd., Kaohsiung (TW); King Slide Technology Co., Ltd., Kaohsiung (TW)

( * ) Notice: Subject to any disclaimer, the term of this patent is extended or adjusted under 35 U.S.C. 154(b) by 77 days.

(21) Appl. No.: 13/539,521

(22) Filed: Jul. 2, 2012

(65) Prior Publication Data

US 2014/0003745 A1 Jan. 2, 2014

(51) Int. Cl.
*A47B 88/00* (2006.01)

(52) U.S. Cl.
USPC ..... 312/334.46; 312/333; 312/334.4

(58) Field of Classification Search
USPC ..... 312/333, 319.1, 265.1–265.4, 334.4, 312/334.5, 334.44–334.47; 384/21; 361/725–727; 211/26
See application file for complete search history.

(56) References Cited

U.S. PATENT DOCUMENTS 3,782,800 A * 1/1974 Remington et al. ..... 312/333
5,417,490 A * 5/1995 Hobbs et al. ..... 312/334.47
6,464,311 B2 * 10/2002 Liang et al. ..... 312/334.46
6,601,713 B2 * 8/2003 Kaminski ..... 211/26
7,140,704 B2 * 11/2006 Chen et al. ..... 312/334.44
8,231,188 B1 * 7/2012 Chen et al. ..... 312/333
8,328,300 B2 * 12/2012 Yu et al. ..... 312/333
8,491,068 B2 * 7/2013 Weng et al. ..... 312/332.1
2002/0074915 A1 * 6/2002 Shih ..... 312/334.5
2003/0107309 A1 * 6/2003 Lauchner ..... 312/334.5
2003/0205539 A1 * 11/2003 Lauchner et al. ..... 211/26
2004/0056572 A1 * 3/2004 Chen et al. ..... 312/333
2010/0200523 A1 * 8/2010 Henderson ..... 211/26

FOREIGN PATENT DOCUMENTS

JP 2013119020 * 6/2013

* cited by examiner

*Primary Examiner* — Janet M Wilkens
(74) *Attorney, Agent, or Firm* — Rosenberg, Klein & Lee

(57) ABSTRACT

A slide rail assembly includes a first, second, and third rail. The second rail is slidably connected to the first rail defining a second path. The third rail is slidably connected to the second path of the second rail. A front and rear support are respectively connected to a front end and rear end of the first rail. A stop member has a fixed section and a resilient section extending from the fixed section. The fixed section is fixed to the front support and the first rail. The stop portion is located at the resilient section. When the third rail is separated from the second rail and the second rail is retracted in the first rail, the stop portion prevents the third rail from being inserted into the second path.

10 Claims, 8 Drawing Sheets

SLIDE RAIL ASSEMBLY

FIELD OF THE INVENTION

The present invention relates to a slide rail assembly, and more particularly, to a slide rail assembly which allows the third rail to be installed to the assembly while the first and second rails are pulled.

BACKGROUND OF THE INVENTION

The conventional detachable slide rail assembly usually connected with rack, cabinet or the like, and the slide rail assembly can be retractable relative to the rack, the cabinet or the like. The conventional slide rail assembly generally comprises an outer rail fixed to the rack, the cabinet or a fixed object, an inner rail fixed to a chassis, a drawer or a movable member, and a mediate rail which is slidably connected between the inner and outer rails. By the mediate rail, the inner rail can be pulled outward relative to the outer rail. The slide rail assembly makes the chassis, the drawer or the movable member be pulled out relative to the rack, the cabinet or the fixed object.

The chassis usually has inner rails located on two sides thereof and the mediate rails are connected to the inner rails so that the chassis is conveniently pulled out from the rack or the chassis is pushed into the rack. The rack has a space so that multiple chasses are installed in the space. For some reasons, such as maintenance or replacement, the chasses need to be removed from the rack. When a chassis is to be removed from the rack, the inner rails are pulled from the rack and the mediate rails are pulled outward, and the inner rails are separated from the mediate rails. When the maintenance or replacement is completed, the mediate rails are installed to the outer rails and located in the rack. When the chassis is installed in the rack, because the mediate rails are located in the rack so that the assembler difficult to see the installation clearly when inserting the inner rails of the chassis into the mediate rails of the rack. Accordingly, the inner rails of the chassis may incorrectly engage with the mediate rails of the rack, and when the chassis is pushed into the rack whole the incorrect installation happens, the rails and the parts on the rails are easily damaged.

The present invention intends to provide a slide rail assembly which has a protection device to prevent the inner rails from inserting into the mediate rails. When the mediate rails are extended relative to the outer rails, the protection device is released and the inner rails are able to be inserted into the mediate rails.

SUMMARY OF THE INVENTION

The present invention relates to a slide rail assembly and comprises a first rail having two first sidewalls and a first connection wall is connected between the two first sidewalls. The first sidewalls and the first connection wall define a first path. A second rail is slidably connected to the first path of the first rail. The second rail has two second sidewalls and a second connection wall connected between the two second sidewalls. The second sidewalls and the second connection wall define a second path. A third rail is slidably connected to the second path of the second rail. The third rail has two third sidewalls and a third connection wall connected between the two third sidewalls. The third rail can be pulled out from the second path of the second rail and separated from the second rail. A front support is connected to the front end of the first rail and a rear support is connected to the rear end of the first rail. A stop member has an arm and a stop portion, wherein the arm has a fixed section and a resilient section extending from the fixed section. The fixed section is fixed to one of the front support and the first rail. The stop portion is located at the resilient section. When the third rail is separated from the second rail and the second rail is retracted in the first rail, the stop portion of the stop member is located in the second path of the second rail so that the third rail is stopped by the stop portion of the stop member and cannot be inserted into the second path of the second rail. When the second rail is pulled out from the first rail, the second sidewall of the second rail contacts the stop portion which is moved away.

Preferably, the second connection wall of the second rail has a positioning member and the first connection wall of the first rail has a restriction member which is located corresponding to the positioning member. When the second rail is partially pulled out relative to the first rail, the positioning member contacts the restriction member so as to restrict the second rail from being retracted relative to the first rail.

Preferably, the third connection wall of the third rail has a release member which is located corresponding to the positioning member of the second rail. When the third rail is inserted into the second rail, the release member pushes the positioning member away from the restriction member, so that the second rail is retracted relative to the first rail.

Preferably, the stop member has a guide portion extending from the stop portion. The guide portion is tilted relative to a front end of the second rail and the front end of the third rail.

Preferably, the first connection wall of the first rail has an opening defined in the front end thereof. The front support has a through hole. The fixed section of the stop member is fixed to the front support. The stop portion extends through the through hole and is located in the opening.

Preferably, the front support has an elongate slot. The stop member extends through the elongate slot and is connected to the front end of the adjacent first rail by the fixed section. The stop portion extends through the elongate slot and is located in the opening.

Preferably, the stop portion extends perpendicularly from the resilient section and is inserted in the second path of the second rail.

Preferably, the stop portion extends in the second path of the second rail and protrudes relative to the third connection wall of the third rail. When the third rail is to be inserted into the second path of the second rail, the third connection wall of the third rail is stopped by the stop portion of the stop member.

Preferably, the stop portion extends in the second path of the second rail. A protrusion extends from the third connection wall of the third rail and toward the second path. When the third rail is to be inserted into the second path of the second rail, the protrusion of the third rail is stopped by the stop portion of the stop member.

Preferably, a handle is connected to the front end of the second connection wall of the second rail.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
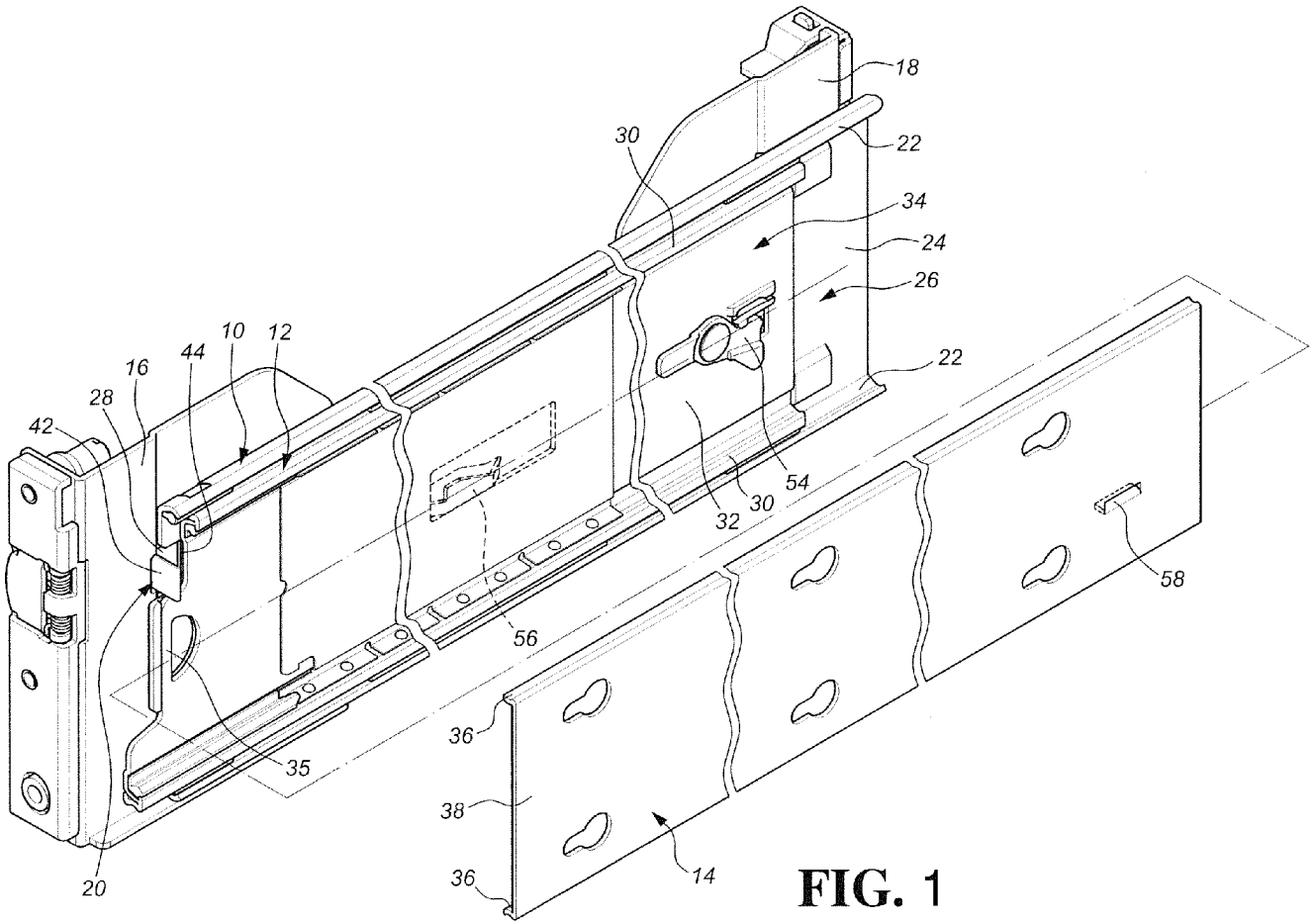
FIG. 1 is an exploded view to show the slide rail assembly of the present invention.

Referring to FIG. 1, the slide rail assembly of the present invention comprises a first rail 10, a second rail 12, a third rail 14, a front support 16, a rear support 18 and a stop member 20.

The first rail 10 has two first sidewalls 22 and a first connection wall 24 connected between the two first sidewalls 22. The first sidewalls 22 and the first connection wall 24 extend along the longitudinal direction and define a first path 26. The first connection wall 24 has an opening 28 defined in the front end thereof.

The second rail 12 is slidably connected to the first path 26 of the first rail 10. The second rail 12 has two second sidewalls 30 and a second connection wall 32 connected between the two second sidewalls 30. The second sidewalls 30 and the second connection wall 32 extend along the longitudinal direction and define a second path 34. A handle 35 is connected to the front end of the second connection wall 32 of the second rail 12 so that the users can hold the handle 35 to pull the second rail 12 from the first rail 10.

The third rail 14 is slidably connected to the second path 34 of the second rail 12. The third rail 14 has two third sidewalls 36 and a third connection wall 38 connected between the two third sidewalls 36. The third rail 14 can be pulled out from the second path 34 of the second rail 12 and separated from the second rail 12.

The front support 16 is connected to the front end of the first rail 10.

The rear support 18 is connected to the rear end of the first rail 10 so that the first rail 10 is connected to a rack (not shown) by the front support 16 and the rear support 18.

Figure 2:
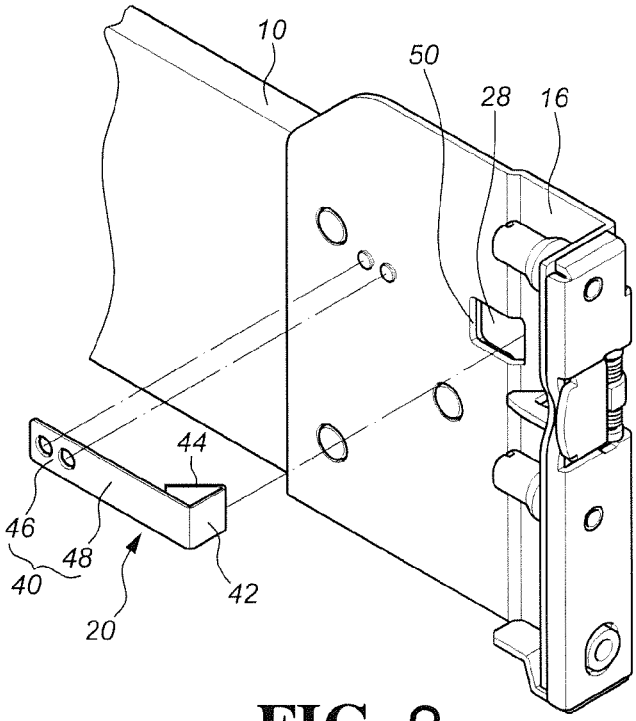
FIG. 2 shows the first way for installation of the stop member of the present invention.
Figure 3:
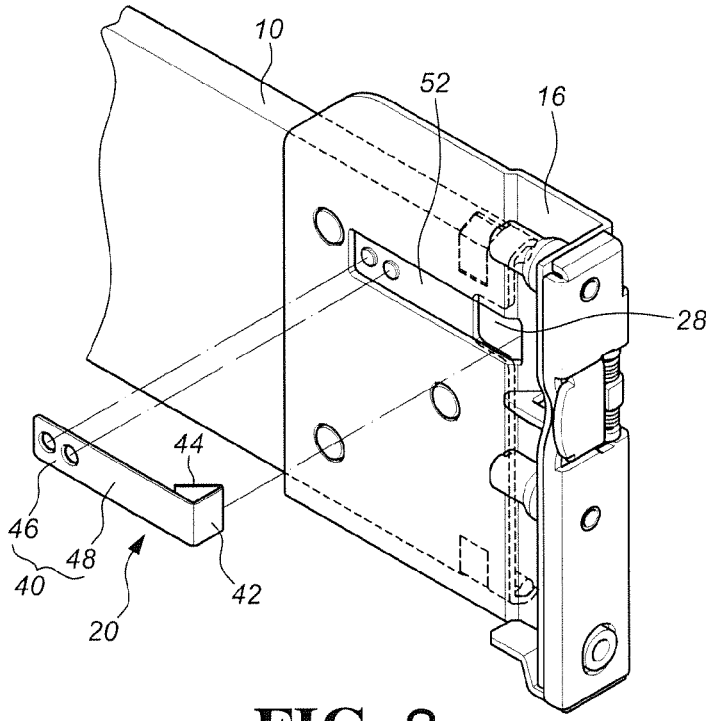
FIG. 3 shows the second way for installation of the stop member of the present invention.

The stop member 20 has an arm 40, a stop portion 42 and a guide portion 44, wherein the arm 40 has a fixed section 46 and a resilient section 48 extending from the fixed section 46. The fixed section 46 is fixed to the front support 16 as shown in FIG. 2 and the resilient section 48 reaches to the front end of the adjacent first rail 10. The stop portion 42 is located at the resilient section 48. The stop portion 42 extends perpendicularly from the resilient section 48 and is inserted in the second path 34 of the second rail 12. Preferably, the front support 16 has a through hole 50. The stop portion 42 extends through the through hole 50 and is located in the opening 28. The height of the stop portion 42 is higher than that of the second path 34 of the second rail 12. The guide portion 44 extends from the stop portion 42. Preferably, the guide portion 44 is tilted relative to the front end of the second rail 12 and the front end of the third rail 14. Alternatively, as shown in FIG. 3, the front support 16 has an elongate slot 52. The stop member 20 extends through the elongate slot 52 and is connected to the front end of the adjacent first rail 10 by the fixed section 46. The stop portion 42 extends through the elongate slot 52 and is located in the opening 28.

Figure 4:
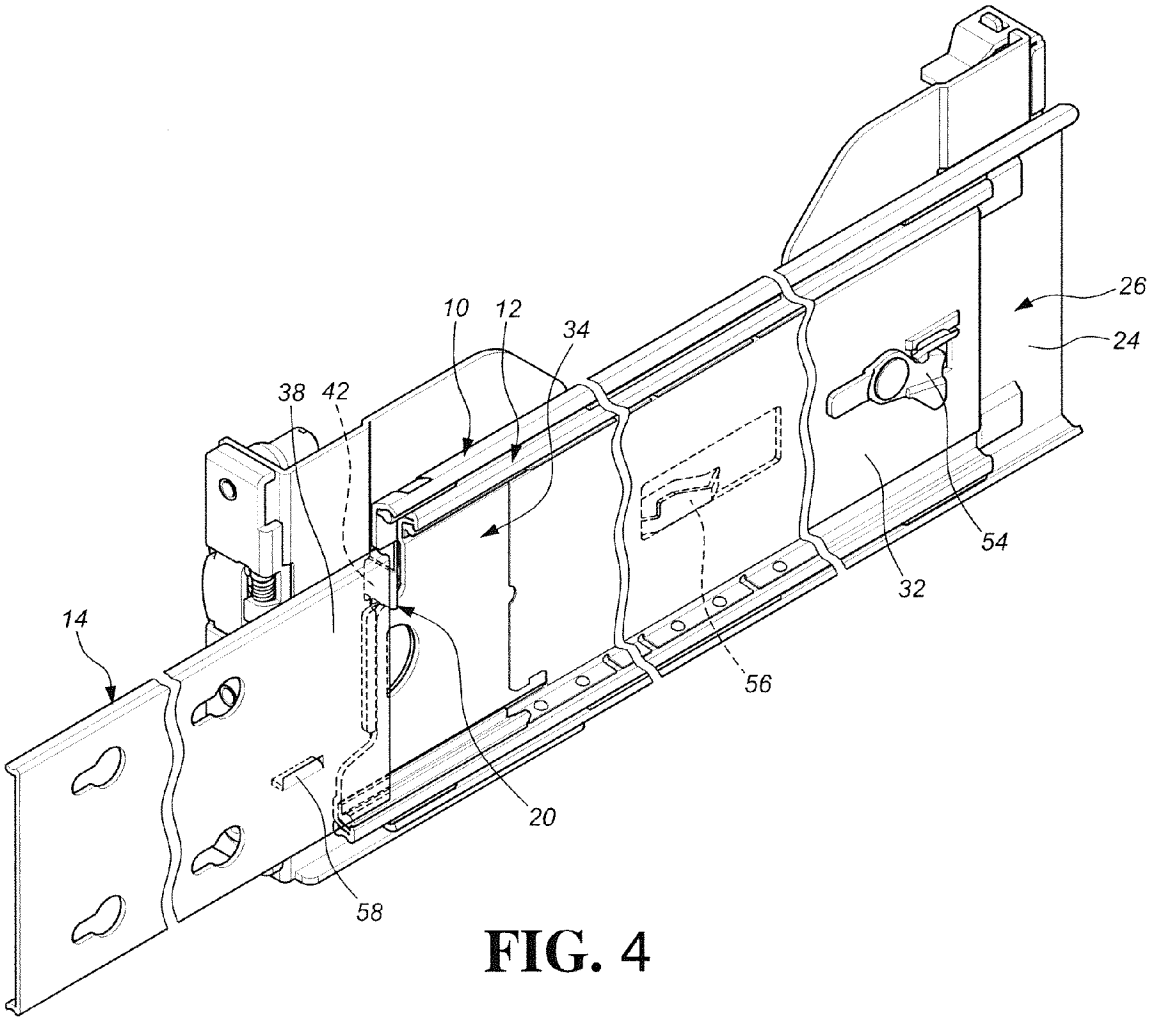
FIG. 4 shows that the third rail is stopped by the stop portion of the stop member and cannot be inserted into the second rail.

When the third rail 14 is separated from the second rail 12 and the second rail 12 is retracted in the first path 26 of the first rail 10, the stop portion 42 of the stop member 20 is located in the second path 34 of the second rail 12 so that the third rail 14 is stopped by the stop portion 42 of the stop member 20 and cannot be inserted into the second path 34 of the second rail 12 as shown in FIG. 4. In other words, because the stop portion 42 extends into the second path 34 of the second rail 12 and protrudes relative to the third connection wall 38 of the third rail 14, so that the third connection wall 38 of the third rail 14 is stopped by the stop portion 42 of the stop member 20. By this arrangement, when the second rail 12 is not yet pulled out from the first rail 10, the third rail 14 cannot be connected to the second rail 12.

Figure 5:
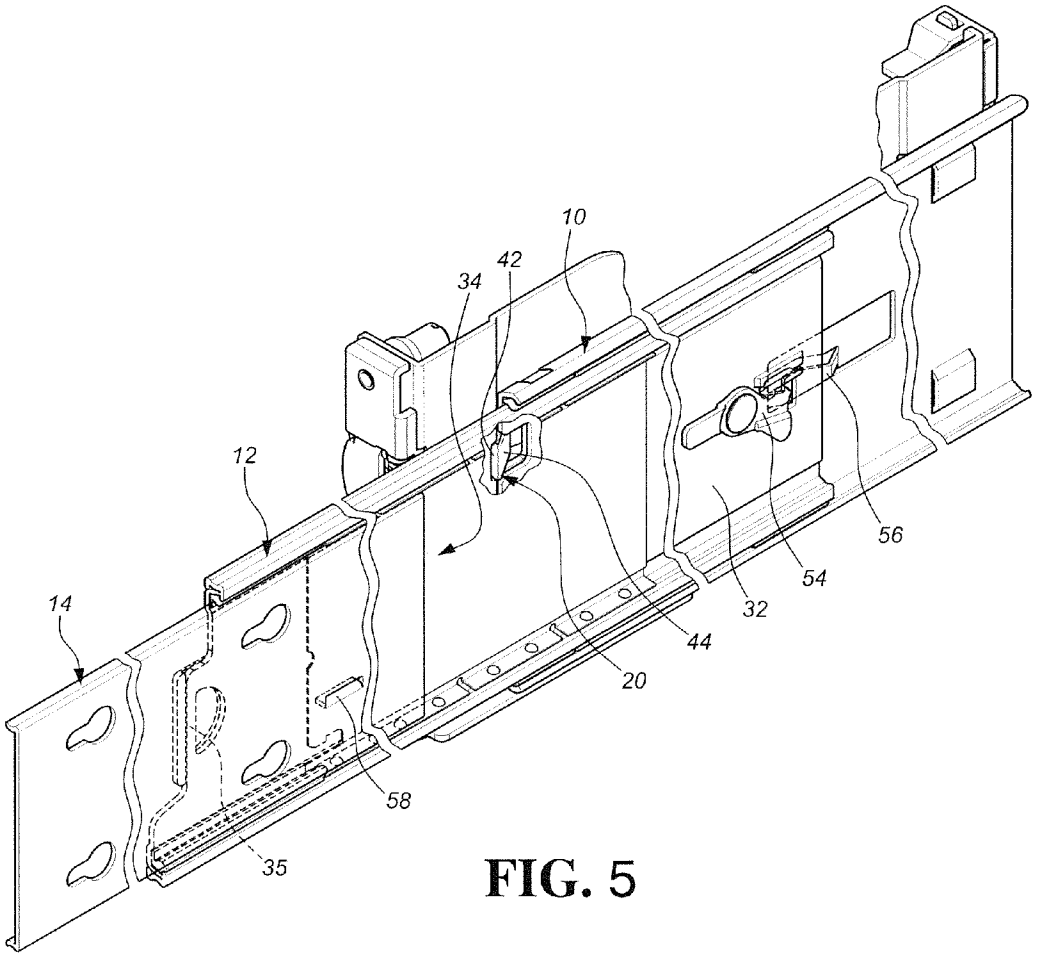
FIG. 5 shows that the third rail is inserted into the second rail.

When the users want to insert the third rail 14 to the second rail 12, as shown in FIG. 5, the second rail 12 needs to be pulled out from the first rail 10 by the use of the handle 35 on the second rail 12 first, along with the second rail 12 is pulled, the guide portion 44 of the stop member 20 is pushed by the second connection wall 32 of the second rail 12, so that the stop portion 42 of the stop member 20 is gradually moved away from the second path 34 of the second rail 12. Because the second connection wall 32 continuously presses the stop portion 42, the stop portion 42 cannot be inserted into the second path 34 of the second rail 12. Therefore, the third rail 14 can be successfully inserted into the second path 34 of the second rail 12.

Figure 6:
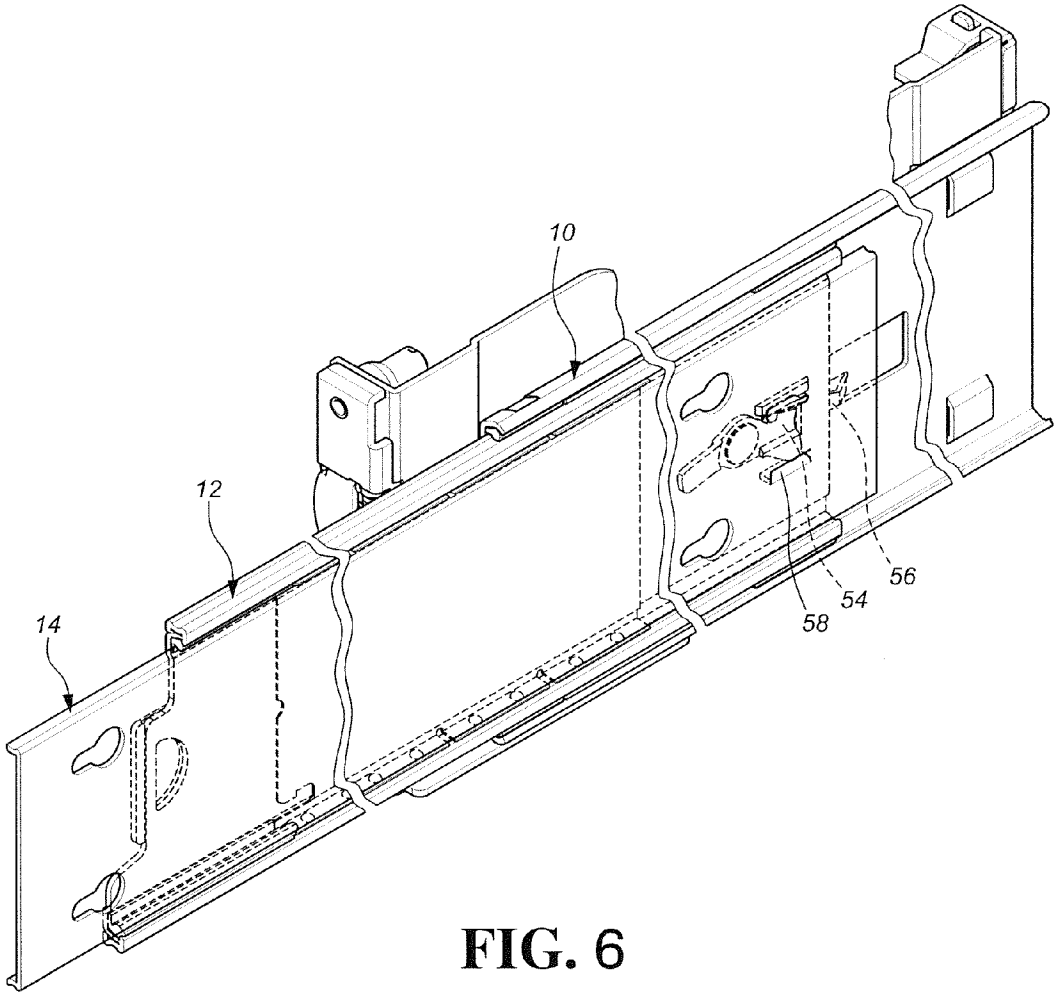
FIG. 6 shows that the second rail is pulled out from the first rail and the third rail is inserted into the second rail.

The second rail 12 needs to be positioned after it is pulled out from the first rail 10 so as to prevent the second rail 12 from re-entering into the first rail 10 when the third rail 14 is to be connected to the second rail 12. In one preferable embodiment, as shown in FIGS. 1 and 4, the second connection wall 32 of the second rail 12 has a positioning member 54 and the first connection wall 24 of the first rail 10 has a restriction member 56 which is located corresponding to the positioning member 54. When the second rail 12 is partially pulled out relative to the first rail 12, as shown in FIG. 5, the positioning member 54 contacts the restriction member 56 so as to restrict the second rail 12 from being retracted relative to the first rail 10. Preferably, the third connection wall 38 of the third rail 14 has a release member 58 which is located corresponding to the positioning member 54 of the second rail 12. When the third rail 14 is inserted into the second rail 12, as shown in FIG. 6, the release member 58 pushes the positioning member 54 away from the restriction member 56, so that the second rail 12 can be retracted relative to the first rail 10.

Figure 7:
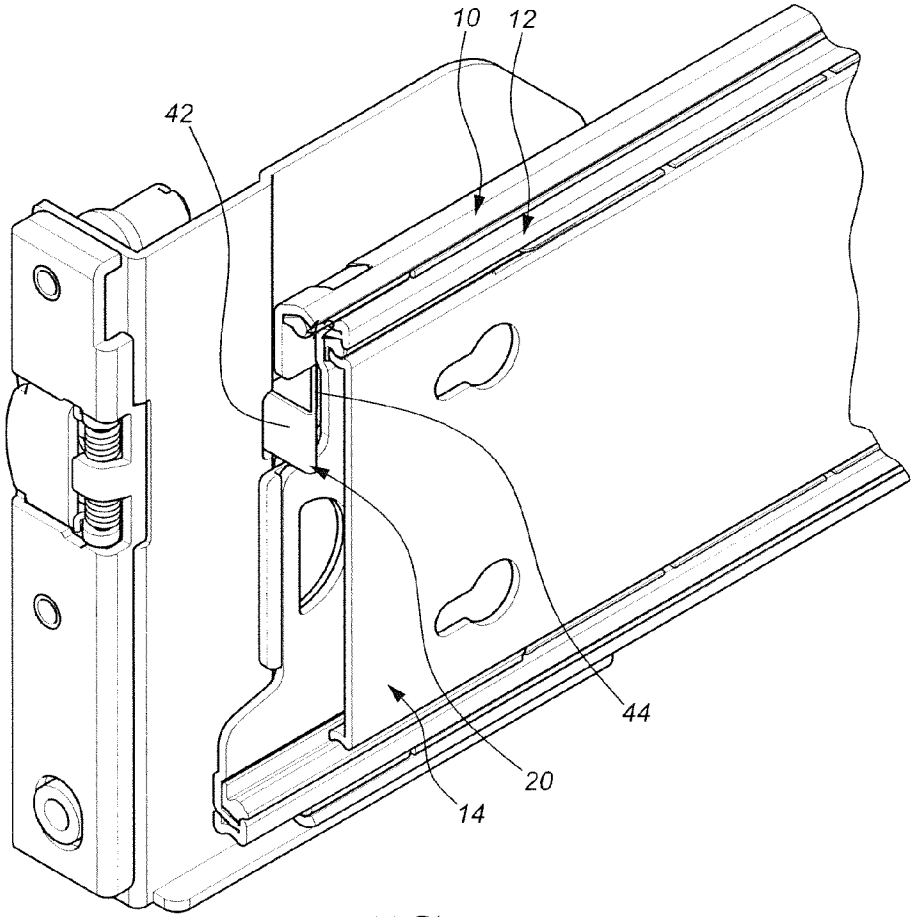
FIG. 7 shows all of the rails are in retracted status.

As shown in FIG. 7, when the third rail 14 is inserted into the second rail 12, and the second rail 12 and the third rail 14 are retracted relative to the first rail 10, the guide portion 44 of the stop member 20 faces the front end of the second rail 12 and the front end of the third rail 14. Therefore, when the second rail 12 and the third rail 14 are pulled relative to the first rail 10, the tilted guide portion 44 provides a guiding surface for the second rail 12 and the third rail 14 and both of which are smoothly pulled.

Figure 8:
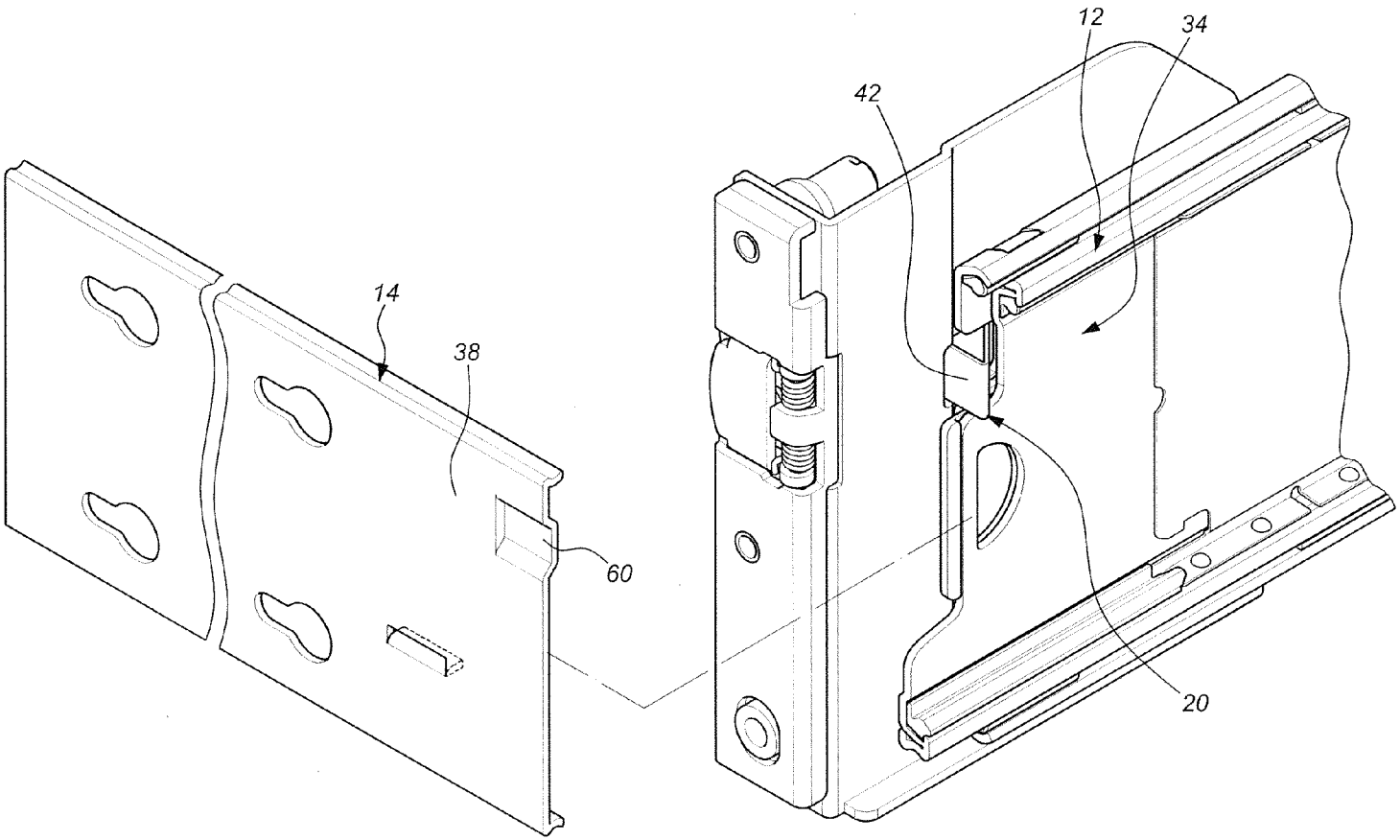
FIG. 8 shows another embodiment wherein the third rail has a protrusion located corresponding to the stop member.
Figure 9:
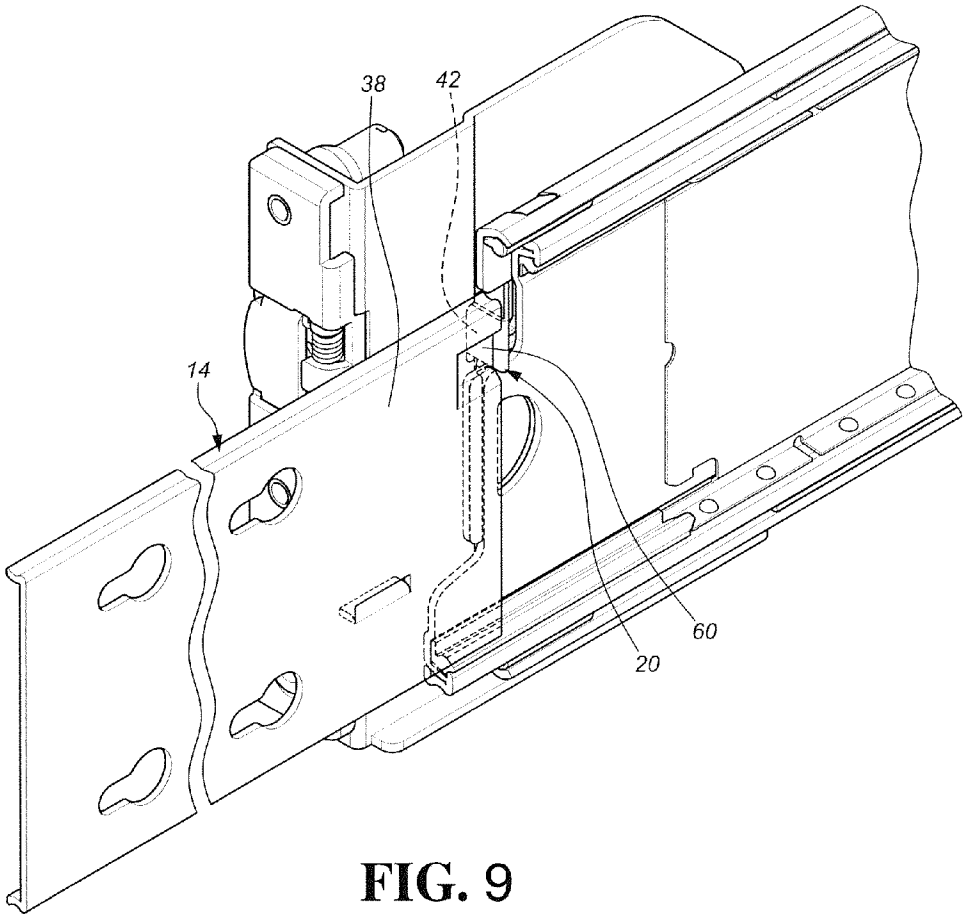
FIG. 9 shows that the third rail is connected to the second rail and is stopped by the stop member.

FIGS. 8 and 9 show that, in another embodiment, if the stop portion 42 of the stop member 20 is located in the second path 34 of the second rail 12, but the stop portion 42 does not protrude beyond the second path 34 of the second rail 12, by the assistance of the protrusion 60 that extends from the third connection wall 38 of the third rail 14 and toward the second path 34, when the third rail 14 is to be inserted into the second path 34 of the second rail 12, the protrusion 60 of the third rail 14 is stopped by the stop portion 42 of the stop member 20.

While we have shown and described the embodiment in accordance with the present invention, it should be clear to those skilled in the art that further embodiments may be made without departing from the scope of the present invention.

What is claimed is:

1. A slide rail assembly comprising:

a first rail having two first sidewalls and a first connection wall connected between the two first sidewalls, the first sidewalls and the first connection wall defining a first path;

a second rail slidably connected to the first path of the first rail, the second rail having two second sidewalls and a second connection wall connected between the two second sidewalls, the second sidewalls and the second connection wall defining a second path;

a third rail slidably connected to the second path of the second rail, the third rail having two third sidewalls and a third connection wall connected between the two third sidewalls, the third rail being pulled out from the second path of the second rail and separated from the second rail;

a front support connected a front end of the first rail;

a rear support connected to a rear end of the first rail;

a stop member having an arm and a stop portion, the arm having a fixed section and a resilient section extending from the fixed section, the fixed section fixed to one of the front support and the first rail, the stop portion is located at the resilient section, and when the third rail is separated from the second rail and the second rail is retracted in the first rail, the stop portion of the stop member is located in the second path of the second rail so that the third rail is stopped by the stop portion of the stop member and cannot be inserted into the second path of the second rail, when the second rail is pulled out from the first rail, the second connection wall of the second rail contacts the stop portion which is moved away.

2. The assembly as claimed in claim 1, wherein the second connection wall of the second rail has a positioning member and the first connection wall of the first rail has a restriction member which is located corresponding to the positioning member, when the second rail is partially pulled out relative to the first rail, the positioning member contacts the restriction member so as to restrict the second rail from being retracted relative to the first rail.

3. The assembly as claimed in claim 2, wherein the third connection wall of the third rail has a release member which is located corresponding to the positioning member of the second rail, when the third rail is inserted into the second rail, the release member pushes the positioning member away from the restriction member, so that the second rail is retracted relative to the first rail.

4. The assembly as claimed in claim 1, wherein the stop member has a guide portion extending from the stop portion, the guide portion is tilted relative to a front end of the second rail and a front end of the third rail.

5. The assembly as claimed in claim 1, wherein the first connection wall of the first rail has an opening defined in a front end thereof, the front support has a through hole, the fixed section of the stop member is fixed to the front support, the stop portion extends through the through hole and is located in the opening.

6. The assembly as claimed in claim 1, wherein the first connection wall of the first rail has an opening defined in a front end thereof, the front support has an elongate slot, the stop member extends through the elongate slot and is connected to the front end of the adjacent first rail by the fixed section, the stop portion extends through the elongate slot and is located in the opening.

7. The assembly as claimed in claim 1, wherein the stop portion extends perpendicularly from the resilient section and is inserted in the second path of the second rail.

8. The assembly as claimed in claim 1, wherein the stop portion extends in the second path of the second rail and protrudes relative to the third connection wall of the third rail, when the third rail is to be inserted into the second path of the second rail, the third connection wall of the third rail is stopped by the stop portion of the stop member.

9. The assembly as claimed in claim 1, wherein the stop portion extends in the second path of the second rail, a protrusion extends from the third connection wall of the third rail and toward the second path, when the third rail is to be inserted into the second path of the second rail, the protrusion of the third rail is stopped by the stop portion of the stop member.

10. The assembly as claimed in claim 1, wherein a handle is connected to a front end of the second connection wall of the second rail.

* * * * *